US005370392A

United States Patent [19]

Chou

[11] Patent Number: 5,370,392

[45] Date of Patent: Dec. 6, 1994

[54] AUTOMATIC STEEL BALL RECOLLECTING APPARATUS

[75] Inventor: Long-Shou Chou, Taipei, Taiwan, Prov. of China

[73] Assignee: Entropy International Co., Ltd., Taipei Hsien, Taiwan, Prov. of China

[21] Appl. No.: 181,176

[22] Filed: Jan. 13, 1994

[51] Int. Cl.[5] ..... A63F 7/02

[52] U.S. Cl. ..... 273/121 B; 273/122 R

[58] Field of Search ..... 273/118, 121, 122, 123, 273/124

[56] References Cited

FOREIGN PATENT DOCUMENTS

| | | | |
|---|---|---|---|
| 739 | 1/1978 | Japan | 273/121 B |
| 2136 | 1/1978 | Japan | 273/121 B |
| 4183493 | 6/1992 | Japan | 273/121 B |
| 5087051 | 3/1993 | Japan | 273/121 B |
| 5084342 | 4/1993 | Japan | 273/121 B |

*Primary Examiner*—Vincent Millin
*Assistant Examiner*—Raleigh W. Chiu
*Attorney, Agent, or Firm*—Bacon & Thomas

[57] ABSTRACT

An automatic steel ball recollecting apparatus for use in pinball machines comprises a score board, a drive motor, a main frame, a slide board, and steel ball trapping units. In the construction of the recollecting apparatus, the score board is provided with a plurality of through holes; the drive motor is mounted on the back of the score board, with an eccentric rotary wheel attached to the output shaft of the motor through a reduce gear and having an eccentric shaft; the main frame situated on the back of the score board is engaged with the eccentric shaft and driven by the motor to produce an up and down motion; the slide board is provided with an electric micro-switch to which a lifting lever is added to extend the trigger bar of the micro-switch and protrudes into a through hole from the back of the score board to form a steel ball trapping unit; the sides of the slide board are equipped with short pins which extend into guide slots formed on sides of the main frame to steer the motion of the main frame in a forward and backward direction via the inclined surface of the guide slot to produce an effect of recollecting the trapping unit out of through holes

4 Claims, 6 Drawing Sheets

AUTOMATIC STEEL BALL RECOLLECTING APPARATUS

BACKGROUND OF THE INVENTION

The invention relates to an automatic steel ball recollecting apparatus, and more particularly to an automatic steel ball recollecting apparatus for use in a recreational pinball machine that makes use of a plurality of small steel balls trapped in holes interspersed on a score board to heighten a recreational effect and has a function of collecting all trapped balls in a tray at one time.

A conventional pinball machine for amusement is provided with a plurality of holes arranged on a score board at predetermined positions for trapping steel balls passing by. There are micro-switches installed behind these holes. When passing over holes, small steel balls roll into the holes, trigger micro-switches and then fall into a tray under the machine.

For such a construction, steel balls enter holes and disappear in a short time and so the visual effect only lasts for an instant when a ball falls into a hole. There is no other things provided for visual recognition except the score displayed on the electronic screen.

In view of the aforesaid shortcoming of a relatively short visual dynamic effect for the conventional construction of a pinball machine, the invention provides an automatic steel ball recollecting apparatus which is applicable for such a recreational machine and has a smart structure that, in cooperation with electronic controllers, can keep the trapped balls halting on the score board, enhancing the freshness of a visual effect and the interest of playing games. It is really a great improvement in the recreational effect of a pinball machine.

SUMMARY OF THE INVENTION

Accordingly, the primary object of the invention is to provide an automatic steel ball recollecting apparatus by which falling steel balls trapped in through holes can be caught and held on the score board to enhance the amusing, visual effect of playing games.

The other object of the invention is to provide an automatic steel ball recollecting apparatus that can synchronize the collection of all trapped steel balls in collecting tray.

To obtain the foregoing objects, the apparatus of the invention is characterized in a score board on the front face of which through holes and steel ball guide posts are interspersed, and a movable main frame situated on the back of the score board and having a transverse bar on which a transverse slot engaged with an eccentric shaft extending from the output shaft of the motor is furnished to guide the motion of the main frame in an up and down direction as the motor rotates to drive the main frame.

A slide board having electric circuits is equipped with lifting levers as many through holes on the score board. Each lifting lever is combined with a micro-switch. The slide board has pins on its sides. A positioning plate with a horizontal transverse guide slot is attached to the back of the score board. With each pin on the sides of the slide board projecting into a transverse guide slot of the positioning plate and a slant slot of a side bar of a main frame, the apparatus of the invention can urge the slide board to move forwards and backwards along with a horizontal displacement of the horizontal transverse guide slot while the main frame moves up and down.

The aforementioned objects, other advantages, and features are best illustrated by an embodiment of the steel ball recollecting apparatus of the invention which is described below in detail, with reference to the accompanied drawings.

DETAILED DESCRIPTION OF PREFERRED EMBODIMENTS

Figure 1:
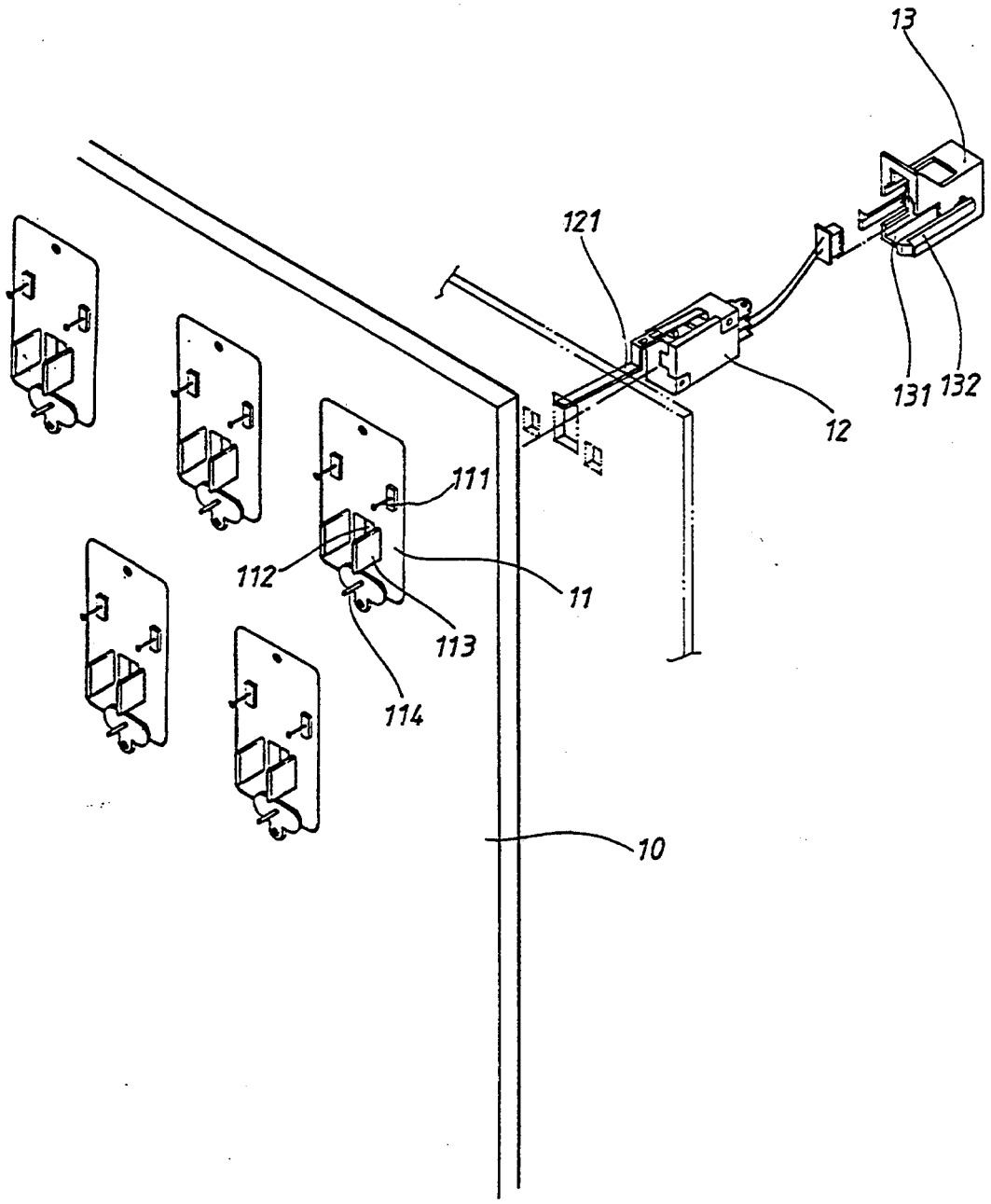
FIG. 1 is an exploded view showing the construction of the steel ball trapping unit of the invention.

Referring to FIG. 1, the invention chiefly comprises a score board 10 with panels 11 secured thereon. Each panel 11 is provided with two guide posts 111 spaced in a distance larger than the ball diameter, a through hole 112, two side plates 113, and a stop post 114. The invention is further featured by a micro switch 12 which is housed in a steel ball trapping unit 13 and has a trigger bar on which is mounted a lifting lever 121 which extends the length of the trigger bar. The lifting lever 121 can slide into the through hole 112 at a proper time to catch a falling steel ball and hold it on the score board. The height of the side plates 113 is less than the diameter of steel balls so that after a falling steel ball is grasped the steel balls coming after it will escape from a gap between the guide posts 111 and the side plates 113.

Figure 2:
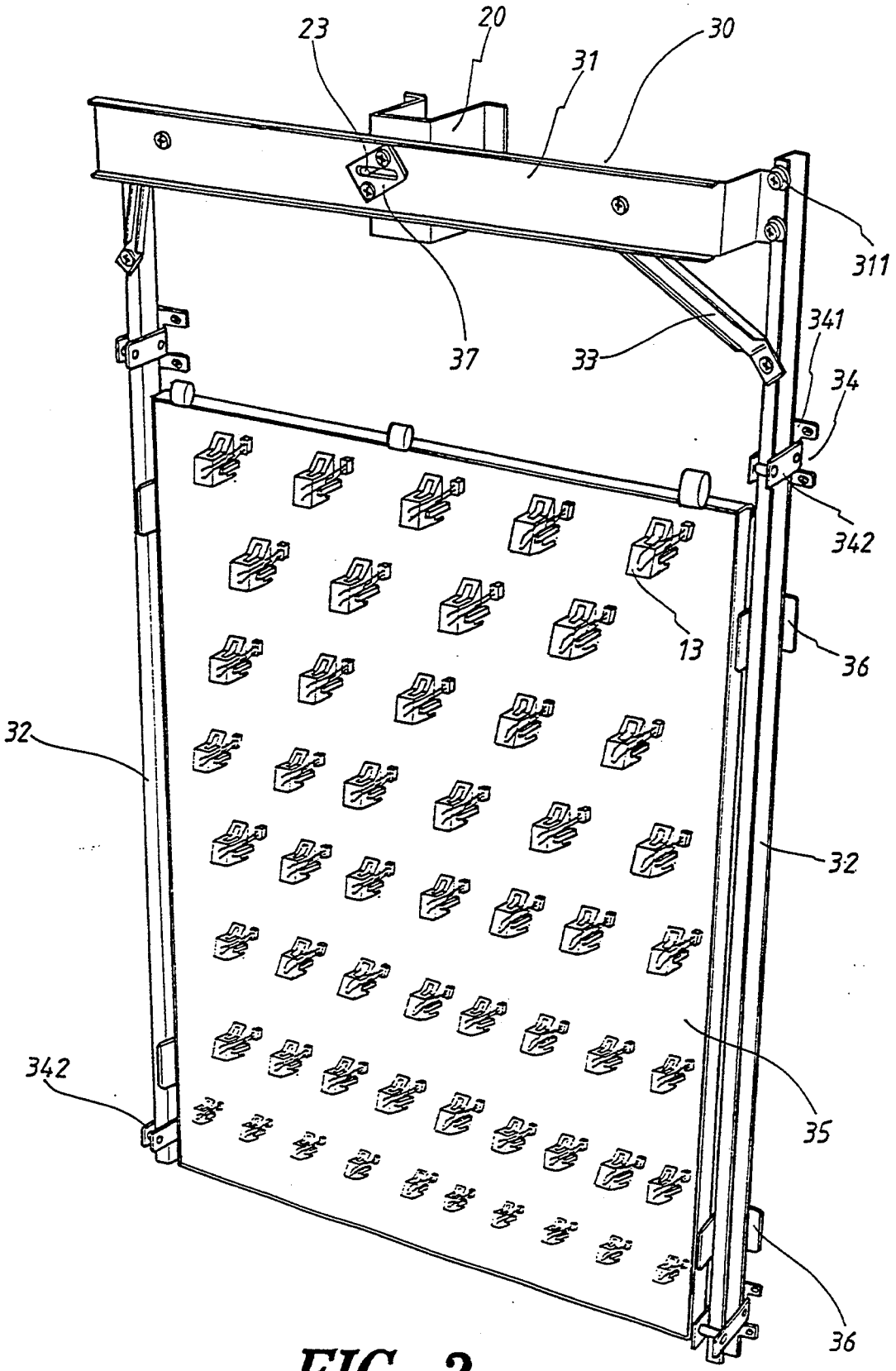
FIG. 2 is a perspective view showing the outer appearance of an embodiment of the steel ball recollecting apparatus according to the invention.
Figure 3:
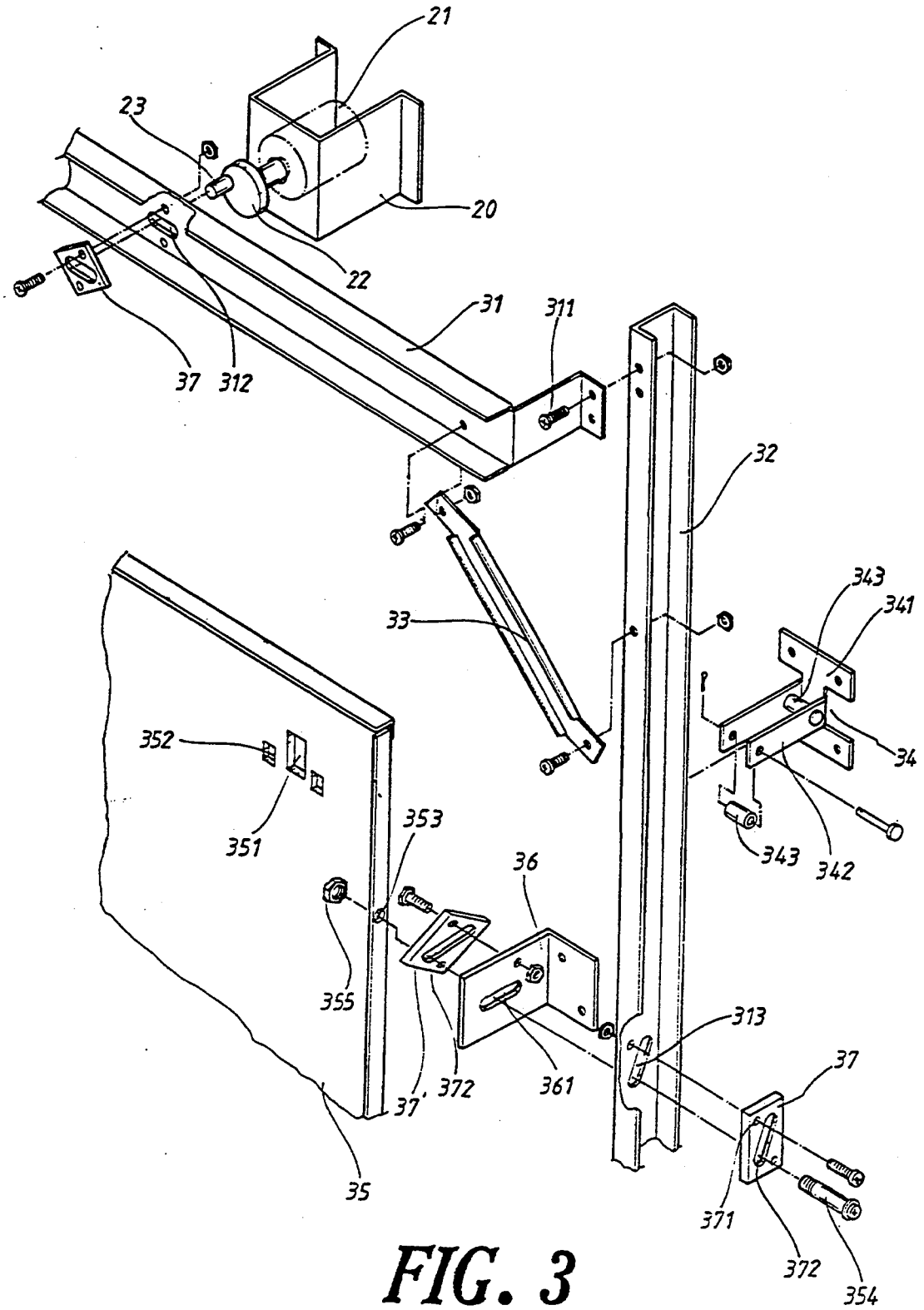
FIG. 3 is an exploded view schematically showing the connecting construction of the main frame and the slide board of the invention.

An embodiment of the invention is shown in FIGS. 2 and 3. In the construction, the steel ball trapping units are disposed on the back of the score board 10 while a U-shaped bracket 20 is provided on the top of the device for mounting a motor. A drive motor 21 through a reduce gear outputs power to an eccentric rotary wheel 22 that is attached to the shaft of the motor and equipped with an eccentric shaft 23 near the rim of the wheel.

The invention further comprises a main frame 30, which consists of an upper transverse bar 31 and two side-bars 32. The upper transverse bar 31 having a transverse slot 312 and the side bars 32 having an inclined slot 313 are jointed by screw fasteners 311. Struts 33 located at the intersection corners of the bars are used to reinforce the strength of the structure. Four locating-brackets 34, each having a base 341 fixed on the back of the score board and vertical side wall plates 342 each slidably clamping a side bar 32 with two rolls 343 supported on the side wall plates 342, are used to constrain the slide motion of the main frame in a vertical direction.

The invention also includes a slide board 35, four positioning plates 36, and spacer blocks 37; the slide board 35 being provided with electrical conductor wires and insertion holes 351,352 and threaded holes 353 on the sides thereof for receiving threaded pins 354, the positioning plate 36 being L-shaped in configuration having a horizontal flat portion attached on the back of the score board and a vertical flat portion with a transverse guide slot 361 formed thereon, the spacer block 37 being a square plastic plate with threaded holes 371 and a slant slot 372 diagonally oriented.

For the assemblage of the embodiment, a spacer block 37 is installed on the main frame 30 in a manner that the slant slot 372 is aligned with the transverse slot 312 of the upper bar 31 of the main frame 30 and engaged with the eccentric shaft 23 of the drive motor 21. The side-portions of the main frame 30 are fixed by four locating-brackets 34 with side bars 32 of the main frame 30 being clamped by the upper and the lower rolls 343 supported on the vertical side wall plate 342. The slide board 35 with steel ball trapping units 13 mounted on the insertion holes 351, 352 is assembled with a spacer block 37 and a positioning plate 36 and secured on the side bars 32 of the main frame by a pin 354 passing through the slant slot 372 of the space block 37, the transverse guide slot 361 of the positioning plate 36, the slant slot 372 of a second spacer block 37', and a threaded hole 353 and fastened by a nut 355.

Figure 7:
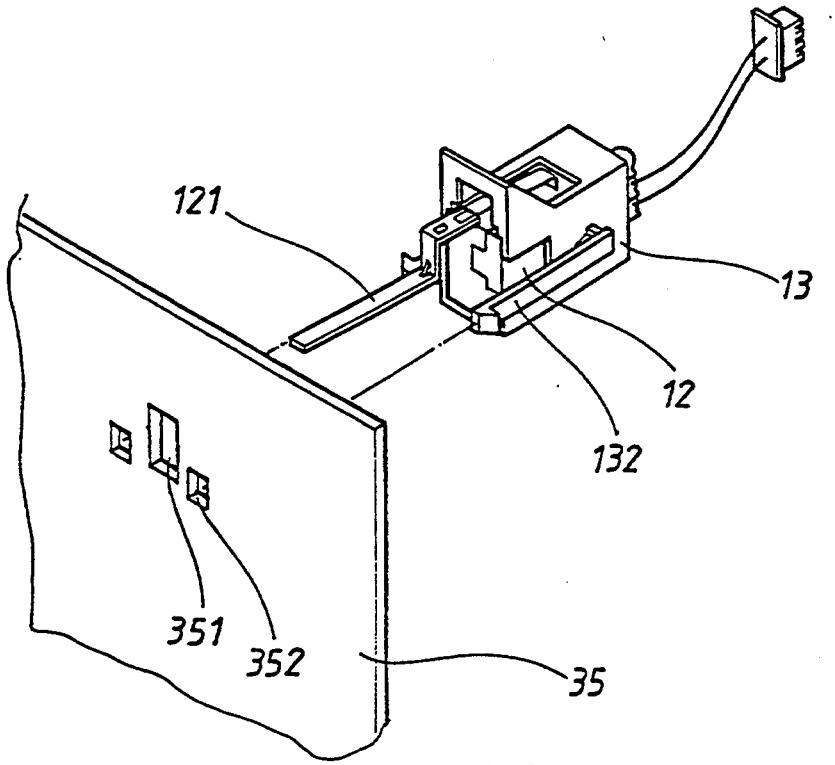
FIG. 7 is an exploded view showing the connecting construction of the slide board and the steel ball trapping unit.
Figure 7A:
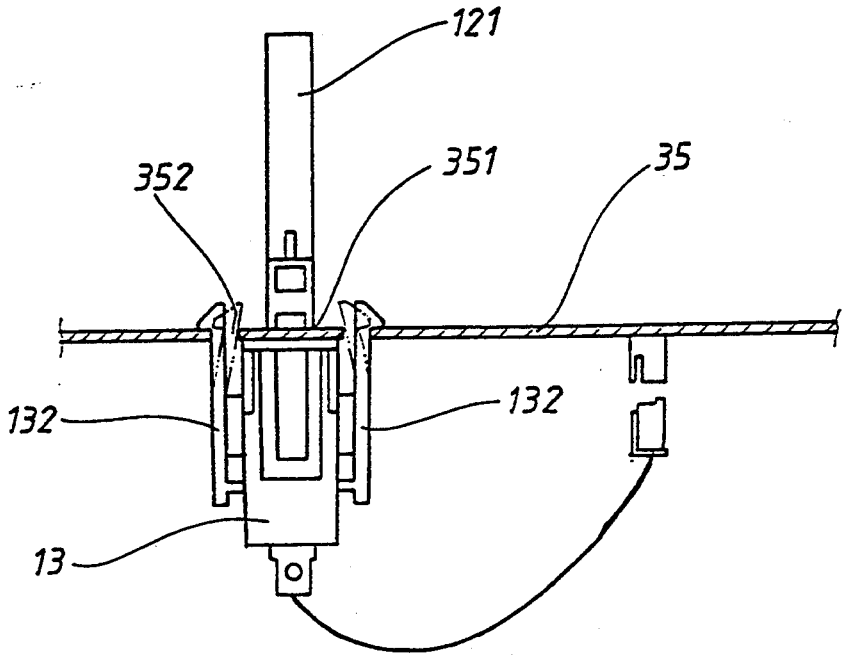
FIG. 7A is a cross sectional view showing the attachment of a steel ball trapping unit to the slide board.

Referring now to FIGS. 1, 7, and 7A for a detailed description of the construction of the slide board 35 and the steel ball trapping unit 13, the slide board 35 is provided with a large insertion hole 351 and two smaller insertion holes 352 and the steel ball trapping unit 13 is a shroud in structure, which has a compartment 131 it and two resilient grasping arms, 132 disposed on sides thereof. A lifting lever 121 is attached to the trigger bar of a micro switch 12 to extend the trigger bar. The micro switch 12 seats in the compartment 131 of the trapping unit 13 with two grasping arms 132 extending into two small insertion holes 352 and grasping the rim of the hole while the lifting lever 121 extending and projecting out of the large insertion hole 51 for a certain length. These two resilient grasping arms 32 are to be pressed inwards when the trapping units 13 are mounted on the slide board 35.

Figure 4:
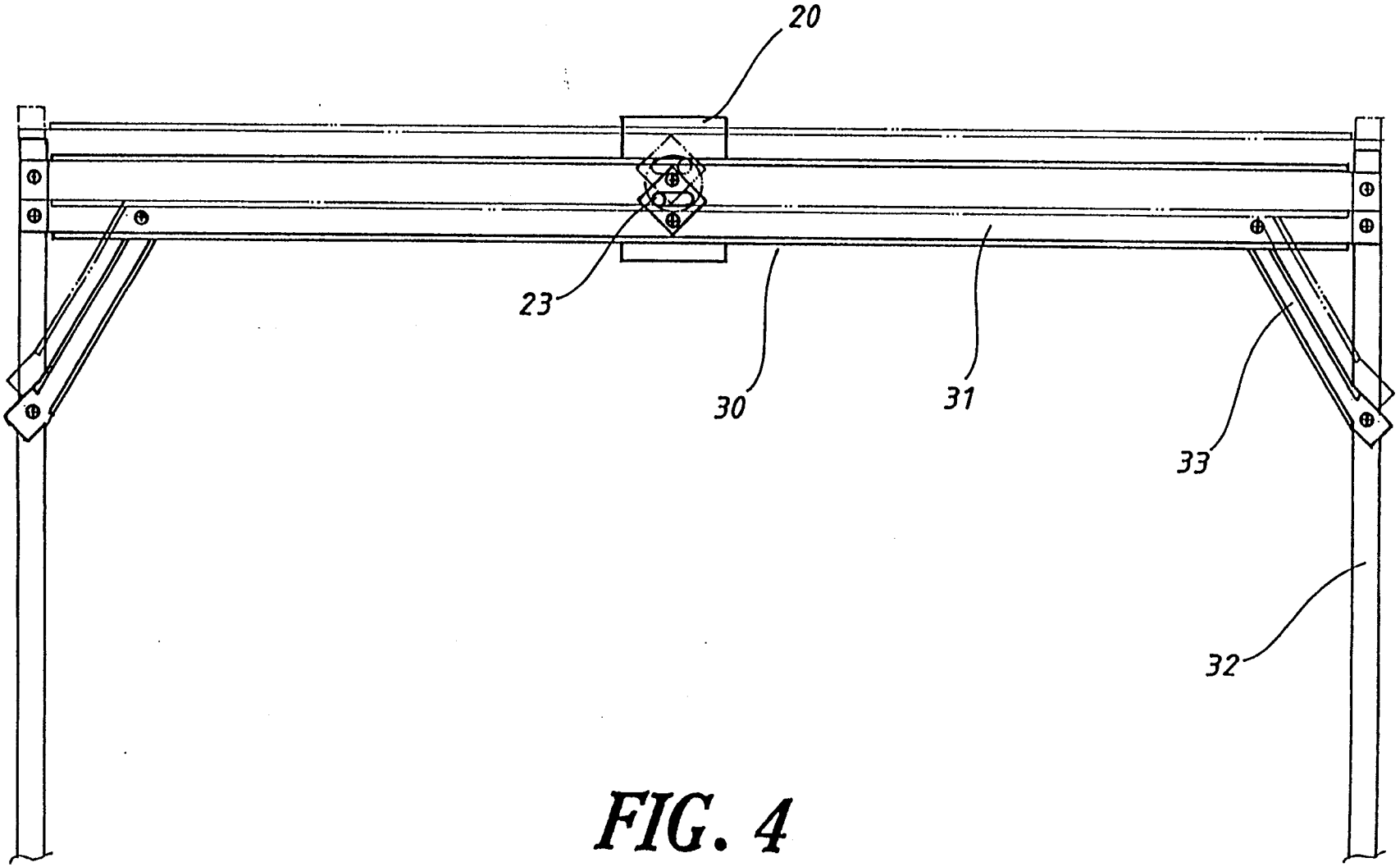
FIG. 4 is a schematic view indicating the rising motion of the main frame of the invention.
Figure 5:
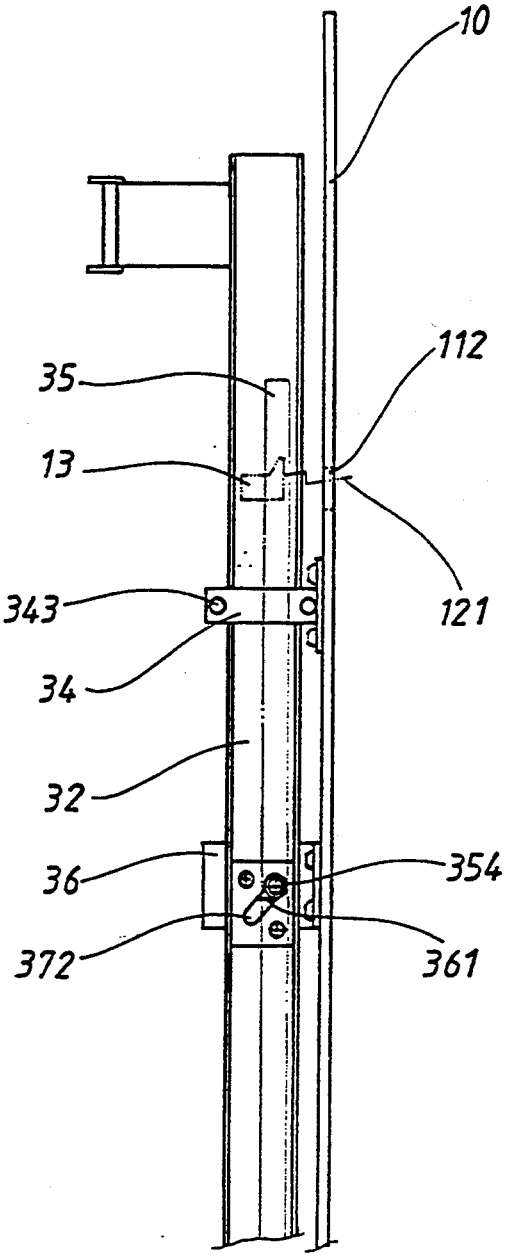
FIG. 5 is a schematic view showing the slide board in front end position.
Figure 6:
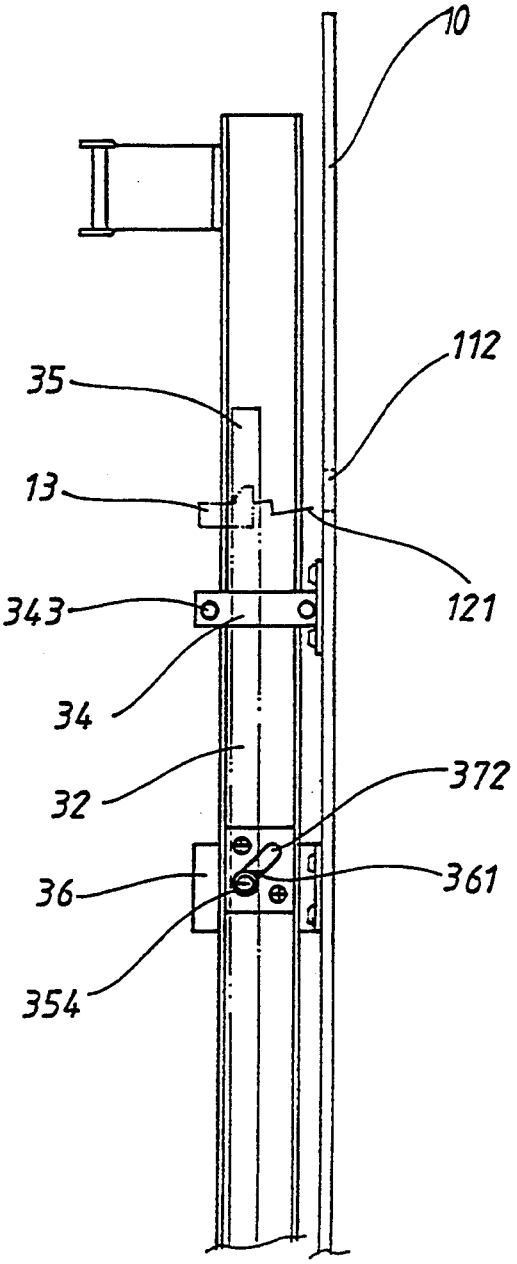
FIG. 6 is a schematic view showing the slide board in a rear end position.

Referring to FIGS. 4 through 6, FIG. 4 illustrates that when the drive motor 21 rotates, the eccentric rotary wheel 22 connected to the motor turns its eccentric shaft 23 from a lower left position to an upper right position, which further moves the main frame 30 to slide on two rolls 343 of the locating bracket 34, producing an up and down sliding motion. As can be seen in FIGS. 4 and 5, the threaded pin 354 of the slide board 35 moves to the upper end of the slant slot 372 formed on the side bar 32 and the right end of the transverse guide slot 361 of the positioning plate 36 when the main frame 30 is driven by the eccentric, shaft 23 to descend. Now referring to FIGS. 4 and 6, the threaded pin 354 of the slide board 35 moves backwards along the slant slot 372 of the side bar 32 and the transverse guide slot 361 of the positioning plate 36 when the drive motor 21 drives the eccentric shaft 354 to ascend, resulting in a backward movement of the steel ball trapping unit 13 on the slide board 35 relative to the score board 10. Accordingly, the trapping unit 13 can entirely get out of the through hole 112 of the score board 10 and complete a steel ball recollecting action.

As described above, the foregoing embodiment of the invention employs an arrangement in which a slide board with steel ball trapping units secured thereon is connected to a main frame and urged to move forth and back following a slot path as a drive motor rotates to move a main frame upwards and downwards in order to complete trapping and recollecting functions for steel balls. Therefore, it provides an excellent steel ball recollecting mechanism that can attain an expected aim.

What is claimed is:

1. An automatic steel ball recollecting apparatus used in pinball machines comprising:

a score board with a plurality of through holes formed on the front face thereof and arranged to form a steel ball trapping zone:

a drive motor fixed to the upper end of the back of said score board, with its shaft supported on a U-shaped bracket and connected to an eccentric rotary wheel having an eccentric shaft;

a main frame constituted of an upper transverse bar with a transverse slot, and two side bars each having an inclined slot and supported on locating brackets;

a slide board having electrical conductor wires, insertion holes to which a steel ball trapping unit with a micro-switch can be attached, and threaded pins disposed on the side ends thereof;

four locating brackets each provided integrally with a base and two vertical side wall plates with rolls supported on the side wall plates;

four positioning plates each being L-shaped in configuration having a vertical portion with a horizontal transverse guide slot and a horizontal portion with threaded holes for fastening the positioning plate to the back of said score board;

a plurality of spacer blocks each having a slant slot and threaded holes;

steel ball trapping units each having a compartment on the central portion thereof and two grasping arms on the side walls thereof;

wherein said main frame is connected to said eccentric rotary wheel by engaging said transverse slot of said upper transverse bar of said main frame with said eccentric shaft of said eccentric rotary wheel, said threaded pins of said slide board passes through slant slot of said spacer block, horizontal transverse guide slot of said positioning plate, and inclined slot of said main frame to link them together, and each micro-switch for electronic scoring is attached to said steel ball trapping unit, with a lifting lever which is connected to the micro-switch extending into said through hole of said score board.

2. An automatic steel ball recollecting apparatus as claimed in claim 1, wherein each of said through holes provided on said score board has at least a pair of guide posts disposed on the sides of each through hole and spaced in a distance slightly larger than a steel ball diameter, there are side plates disposed on sides of each said through hole and having a height less than the diameter of steel ball, and a steel ball stop post is arranged at a middle position right below each said through hole.

3. An automatic steel ball recollecting apparatus as claimed in claim 1, wherein said locating bracket supporting said main frame is attached to the back of said score board and there are an upper and a lower roll supported on each of said locating brackets to slidably clamp the side bars of said main frame to give the main frame a smooth slide motion.

4. An automatic steel ball recollecting apparatus as claimed in claim 1, wherein said steel ball trapping unit has a lifting lever attached to a trigger bar of a micro-switch that seats in said central compartment of the trapping unit and on sides thereof two resilient grasping arms that can be pressed inwards to facilitate the insertion of the trapping unit and that are used to secure the trapping unit on to said insertion holes of said slide board, with said lifting lever projecting out of a large hole of slide board for a certain distance.

* * * * *